United States Patent [19]

Johnson

[11] 4,311,236

[45] Jan. 19, 1982

[54] PACKAGE PRODUCT AND METHOD

[75] Inventor: Dwight N. Johnson, San Marcos, Calif.

[73] Assignee: JH Industries, Inc., San Marcos, Calif.

[21] Appl. No.: 247,064

[22] Filed: Mar. 24, 1981

[51] Int. Cl.[3] ..... B65D 73/00

[52] U.S. Cl. ..... 206/488; 53/397; 206/805

[58] Field of Search ..... 206/486, 487, 488, 489, 206/490, 805; 53/396, 397

[56] References Cited

U.S. PATENT DOCUMENTS

| | | | |
|---|---|---|---|
| 1,639,672 | 8/1927 | Schraysshuen | 206/486 |
| 1,957,377 | 5/1934 | Whittle | 206/488 |
| 2,868,371 | 1/1959 | Thorpe | 206/486 |
| 4,023,759 | 5/1977 | Perkins | 206/488 |

FOREIGN PATENT DOCUMENTS

| | | | |
|---|---|---|---|
| 1525155 | 9/1978 | United Kingdom | 206/486 |

*Primary Examiner*—Joseph Man-Fu Moy
*Attorney, Agent, or Firm*—Mason, Kolehmainen, Rathburn & Wyss

[57] ABSTRACT

A product and method for packaging a flush valve on a display card wherein the valve is self-supporting on the card and the package requires no components or elements other than the valve and the card. The flush valve includes a flanged body portion received in an aperture in the card with the flange overlying a surface of the card. An elongated flexible lift strap extending from the valve is wrapped around the card and valve to hold the valve in place on the card. An end of the strap is frictionally retained in an opening in the card to maintain the strap in its wrapped condition.

13 Claims, 4 Drawing Figures

PACKAGE PRODUCT AND METHOD

The present invention relates to a package product and method, and more particularly to a product and method for the packaging of a flush valve on a display card.

A flush valve, also called a flapper valve or flapper tank ball, is a valve cooperating with the outlet valve seat of a toilet water flush tank. The valve is lifted from the seat to effect a toilet flushing operation wherein water flows from the tank. An example of a flush valve of the type to which the package product and method of present invention relates is described in a co-pending application of Dwight N. Johnson, Ser. No. 55,768, filed July 9, 1979, a continuation of application Ser. No. 927,151, filed July 21, 1978 (now abandoned), in turn a continuation of application Ser. No. 718,048, filed Aug. 26, 1976 (now abandoned).

Substantial numbers of flush valves are sold at retail in the replacement market. For display and storage in retail outlets, it is desirable that the flush valve be packaged on a display card so that the package can be suspended from a hook or other support with the valve and the product information typically printed on the card easily visible and accessible to a shopper.

A typical package used for flush valves in the past, called a blister pack, includes a display card upon which the flush valve is supported by a transparent, formed plastic envelope or blister. This package has been found to have substantial disadvantages. One disadvantage is that the flush valve is isolated between the card and the blister or envelope. Although the flush valve is visible, the shopper is prevented from touching or feeling the valve and directly ascertaining the characteristics of the valve material. Another disadvantage is the cost incident to the manufacture and assembly of a blister package.

Other expedients have been used for mounting products on display cards. One approach has been to retain a product on a card by frictional engagement. This type of package has been believed inappropriate for a soft, molded product such as a flush valve which does not lend itself to being tightly forced into apertures, slits or the like in a card. Another approach has been to secure a product, or a bag or the like containing the product, to the card with fasteners such as staples or other retaining elements. This approach is expensive, and does not provide an attractive package.

Among the objects of the present invention are to provide an improved package product and method; to provide a product and method for packaging a flush valve on a display card wherein no components or elements other than the valve and card are required; to provide a flush valve package and packaging method of very low cost; to provide a package product and method for a flush valve wherein the flush valve is securely retained on a display card yet can be touched; and to provide a package product and method overcoming disadvantages of package products and methods used in the past.

In brief, in accordance with the above and other objects and advantages of the invention, there is provided a packaged valve product comprising a flat, planar card member upon which a flush valve including a valve structure and an elongated, flexible lift strap is mounted. The valve structure includes a main body portion surrounded by an outwardly projecting annular flange. The valve structure is positioned on the card with the main body portion extending through an aperture in a card and with the flange abutting the surface of the card surrounding the aperture. The lift strap is wrapped around the card and valve structure securely to hold the valve structure in position on the card. The lift strap is frictionally engaged with a hole in the card to maintain the lift strap in the wrapped condition.

In brief, a method in accordance with the present invention for packaging a flush valve having a valve body and lift strap on a card having an aperture and a smaller opening comprises the steps of positioning the valve body and the card with part of the valve body extending through the aperture, wrapping the lift strap around the card and valve body, and inserting the end of the lift strap through the opening in the card.

The present invention together with the above and other objects and advantages thereof may best understood with reference to the following detailed description of a packaged valve product embodying the invention and assembled in accordance with method of the invention. In the drawings.

Figure 2:
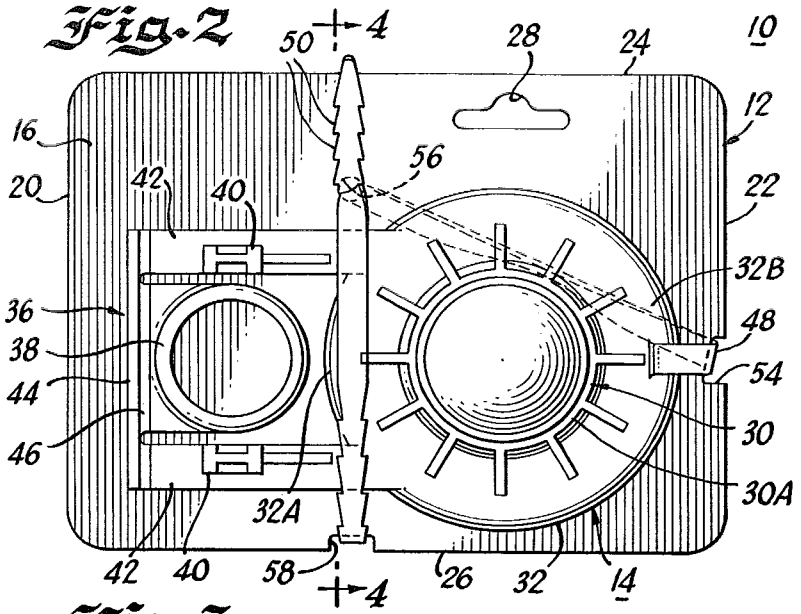
FIG. 2 is a front elevational view of the package.
Figure 3:
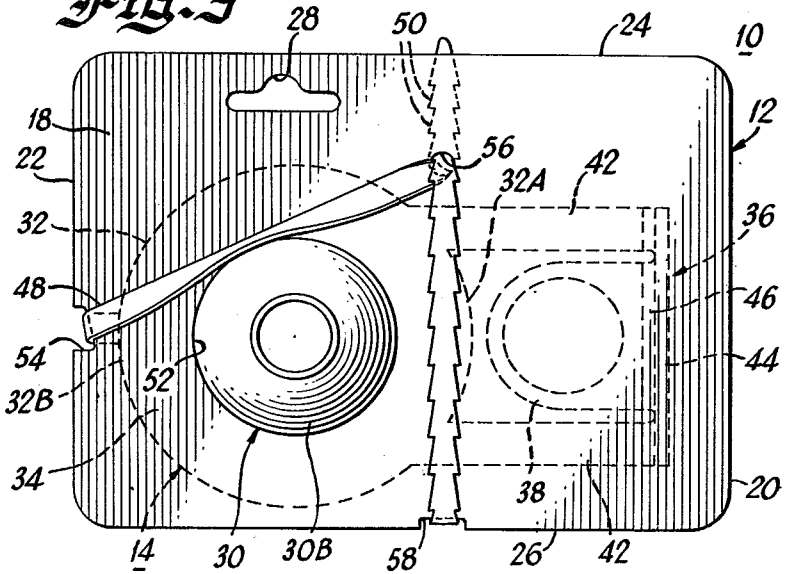
FIG. 3 is a rear elevational view.
Figure 1:
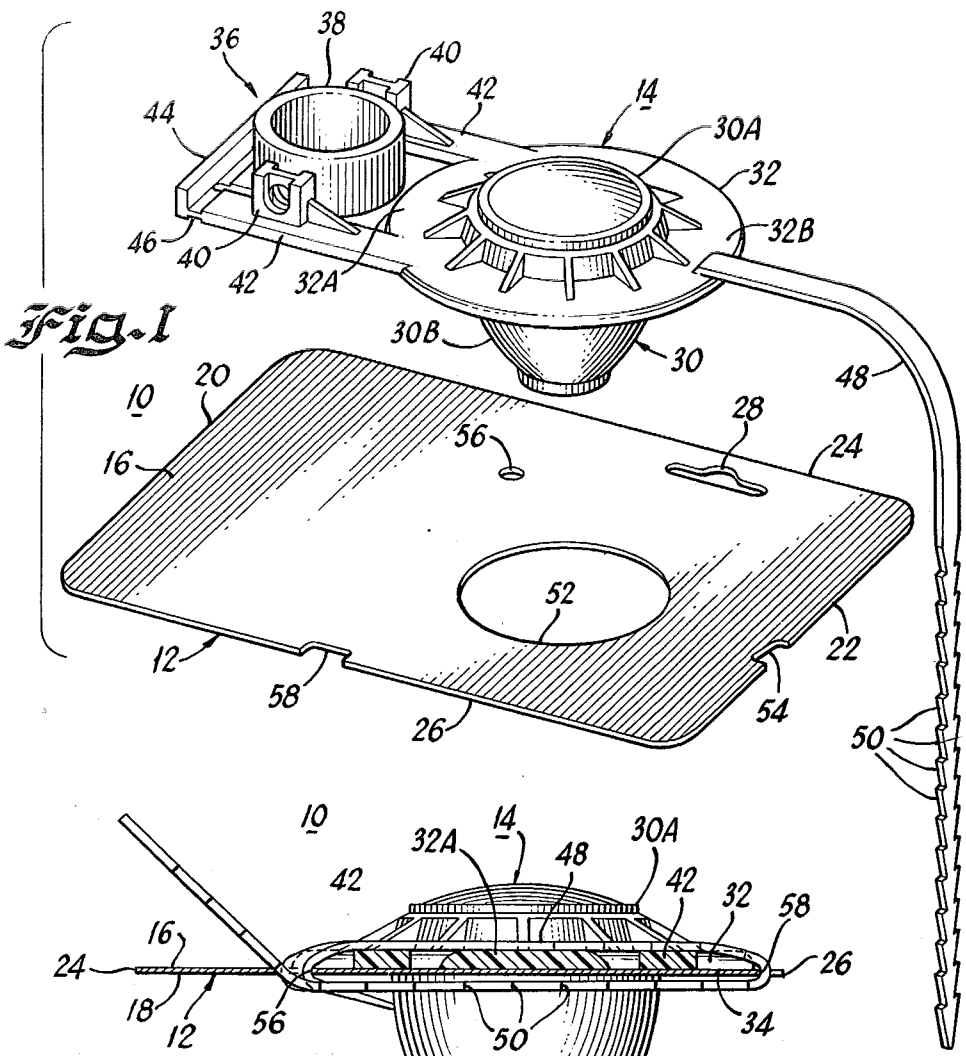
FIG. 1 is a perspective view of the components of the package of the invention before assembly.
Figure 4:
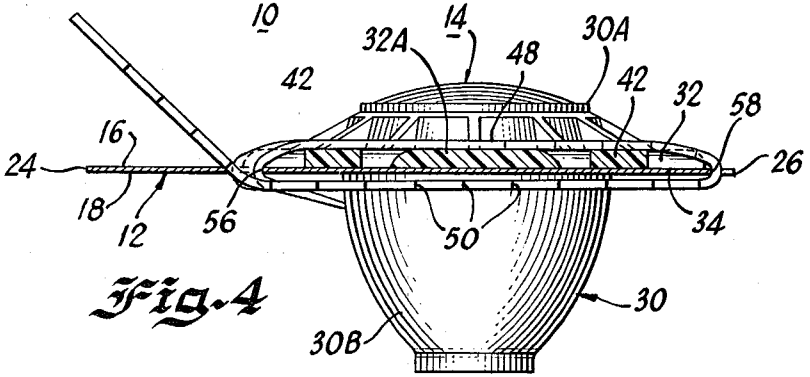
FIG. 4 is a sectional view taken along the line 4—4 of FIG. 2.

Having reference now to the drawings, there is illustrated a packaged valve product designated in its entirety by the reference numeral 10. The product 10 includes a display card 12 upon which is self-supported a flush valve generally designated as 14.

In accordance with conventional practice, the display card 12 is a flat, planar piece of card stock having a front surface 16, an opposed rear surface 18, side edges 20 and 22, and top and bottom edges 24 and 26. A hole 28 is formed in the card 12 adjacent the top edge 24 to permit the package 10 to be suspended from a hook or other device for storage and display purposes in a retail store. The front and rear surfaces of the card 12 may include suitable printed text and/or pictorial material such as product designations and information, installation instructions and the like.

The flush valve 14 includes a valve body member or float 30 with an outwardly projecting annular flange 32 disposed between an upper body portion 30A and a lower body portion 30B. The bottom of the flange 32 defines a valve surface 34 engagable with a flush valve seat in a toilet water tank.

A mounting structure generally designated as 36 extends from a first region 32A of the flange 32. A collar 38 or ears 40 are used to mount the flush valve 14 in a toilet tank. Spaced arms 42, a torque beam 44 and a hinge structure 46 permit the valve body member or float portion 30 to move with respect to the flush valve seat in a toilet tank.

A lift strap 48 extends from a portion 32B of the flange 32 generally opposed to the portion 32A. The lift strap is elongated, flexible and resilient. The end segment of the lift strap 48 includes an array of ratchet teeth 50 for securing the lift strap 48 to a lift arm or other lifting mechanism in a toilet tank.

The entire flush valve 14 including the body member 30, the flange 32, the mounting structure 36 and the lift strap 48 is formed as a one-piece, integral, single body of material. Preferrably the material is a homogeneous, molded vinyl or the like having a hardness in the 45 to 50 durometer range. A further description of the flush valve 14 beyond that necessary to an understanding of the present invention is included in the above-identified copending application Ser. No. 55,718, incorporated herein by reference.

In accordance with the present invention, the flush valve 14 is self-supported upon the display card 12 in an exposed condition and without the requirement for any securing elements, containing structures, or the like. In order to hold the valve 14 on the card 12, the lift strap 48 is wrapped around the card and the valve.

More specifically, the card includes a relatively large aperture 52 sized freely to receive the lower portion 30B of the valve body member 30. The valve 14 is positioned on the card 12 with the body portion 30B extending through the aperture 52 and with the flange portion 32 overlying the front surface 16 of the card. Thus, the valve surface 34 is in engagement with that portion of the card surface 16 surrounding and adjacent to the aperture 52. The aperture 52 is somewhat larger in size than the corresponding dimension of the valve portion 30B and the valve 14 can easily be positioned on the card without the requirement for close tolerances or for forcing the valve portion 30B into the aperture 52.

When the valve body member 30 has been positioned on the card, the mounting structure 16 also overlies the front surface 16 of the card. Consequently, the mounting structure 36, the flange 32, and the entire upper portion 30A of the valve body are visible at the front of the card and are exposed for convenient inspection and touch by a shopper. Moreover, the lower valve body portion 30B is also accessible since it projects from the rear surface 18 of the card.

Lift strap 48 serves to hold the valve 14 in place on the card. The lift strap 48 extends from the flange segment 32B toward the side edge 22 of the card 12. A notch 54 is formed in edge 22 to receive the lift strap 48. The notch assures that the valve 14 is initially positioned on the card 12 in the desired illustrated position, and will remain in that position during subsequent shipping and handling of the package 10.

From the notch 54, the lift strap 48 extends across the rear surface 18 of the card 12 and through an opening 56 extending between the front and rear card surfaces 16 and 18. The opening 56 is positioned in the card so that the strap, in extending from the notch 54 to the opening 56, is positioned to the side of the valve body portion 30B, but lightly engages the portion 30B to assist in holding the valve 14 in position.

From the opening 56, the lift strap 48 extends to a second notch 58 in the lower edge 26 of the card 12. The opening 56 and the notch 58 are located approximately equal distances from the flange region 32A and the mounting structure 36. Consequently, the lift strap 48 overlies these portions of the valve 14 and holds the valve 14 against the front surface 16 of the card. This portion of the strap also cooperates with the notch 54 in assuring that the valve 14 is not displaced or rotated in the aperture 52 from the desired position illustrated in the drawings.

The notches 54 and 56 are slightly larger than the corresponding cross sectional dimensions of the lift strap 48. One result of this configuration is that the strap 48 is easily placed in the notches during wrapping of the strap without forcing. Another advantage is that in the final package, the strap 48 does not extend beyond the the card edges so that the card can be received without interference in a shipping carton or container, and can be handled without interference with the strap 48.

From the notch 58, the lift strap extends across the rear surface 18 of the card to the opening 56. The end segment of the strap 48 extends through the opening 56 from the rear surface 18 to the front surface 16 of the card. The ratchet teeth 50 assist in frictionally retaining the end of the strap 48 in position in the opening 56 so that the mounting of the valve 14 on the card 12 is secure. Since the end of the strap 14 protrudes from the front card surface 16, the structure of the end of the strap 48 and particularly the holding function of the ratchet teeth 50 is readily apparent to a shopper. Frictional retention of the end of strap 48 in the opening 56 is enhanced because the lift strap 48 extends twice through the opening 56.

The wrapped lift strap 48 holds the valve 14 on the card 12 in a secure and stable fashion because the opposed flange portions 32A and 32B are held against the front surface 16 of the card. Due to the spacing between the arms 42, the securement is in the nature of a three-point attachment.

Most of the mounting structure 36 extends beyond the overlying portion of the strap 48. A shopper inspecting the package can move and flex the mounting structure 36 to experience the characteristics of the valve 14 having to do with motion of the valve body member 30 relative to the fixed toilet tank structure to which the mounting structure 36 is to be attached.

In carrying out the method of the present invention, the flush valve 14 is positioned upon the display card 12 with the valve body portion 30B received in the aperture 52 and with the annular flange portion 32 overlying the front card surface 16. The lift strap 48 is then wrapped around the card and the valve along a path which extends from the flange portion 32B to the notch 54 in edge 22, across the rear surface 18 to the opening 56, through the opening 56, over the front surface of the card 16 across the flange portion 32A to the notch 58 in the edge 26, and back across the rear card surface 18. The end portion of the lift strap 48 is then inserted through the opening 56 from the rear card surface 18 to the front card surface 16 to maintain the lift strap 48 in wrapped condition thus to maintain the flush valve 14 secure on the display card 12. The lift strap 48 being resilient may be slightly stretched as it is wrapped to assure that it is wrapped tightly.

While the invention has been described with reference to details of the illustrated embodiment, such details are not intended to limit the scope of the invention as defined in the accompanying claims.

What is claimed and desired to be secured by Letters Patent of the United States is:

1. A packaged valve product comprising:

a flat, planar card member;

a flush valve including a valve structure and an elongated, flexible lift strap extending from said valve structure;

said valve structure including a main body portion surrounded by an outwardly projecting annular flange;

an aperture in said card larger than at least part of said main body portion and smaller than said flange;

said valve structure being positioned on said card with said main body portion extending through said aperture and with said flange abutting the surface of said card surrounding said aperture;

said lift strap being wrapped around said card and valve structure; and an end portion of said lift strap being secured to said card.

2. The packaged valve product of claim 1 wherein said valve structure and said lift strap are integral parts of a single, one-piece unitary, body of molded material.

3. The packaged valve product of claim 1 further comprising an opening formed in said card spaced from said aperture, said lift strap end portion extending through said opening and being secured to said card by frictional engagement within said opening.

4. The packaged valve product of claim 3, said lift strap end portion including ratchet teeth in engagement with said opening.

5. The packaged valve product of claim 1, said card including notches formed in the card edge, said lift strap being received in said notches.

6. The packaged valve product of claim 1, said valve structure including a mounting structure extending laterally from said main body portion and overlying said surface of said card.

7. A packaged valve product comprising a card having a relatively large aperture and a relatively small opening formed therein, a flush valve including a valve body, an annular flange extending from the valve body, an elongated integral lift strap extending from a first region on the flange, and a valve mounting structure extending from an opposed second region on the flange, said flush valve being positioned on said card with said valve body extending through said aperture and with said flange and said mounting structure overlying a first surface of the card, said strap being wound around said card and flush valve along a path extending from said first region to the edge of the card, across the second surface of the card, extending through said opening to the first surface of the card, overlying said second region of the flange and extending to the edge of the card, extending across the second surface of the card, and extending through said opening from the second to the first surface of the card.

8. A method of packaging a flush valve having a valve body and lift strap on a card having an aperture and an opening smaller than the aperture, said method comprising:

positioning the valve body on the card with part of the valve body extending through the aperture;

wrapping the lift strap around the card and valve body; and inserting the end of the lift strap through the opening in the card.

9. The method of claim 8 wherein the lift strap is resilient and said method includes stretching said lift strap during said wrapping step.

10. The method of claim 8, wherein said wrapping step includes inserting said lift strap through the opening in the card.

11. A packaged valve product consisting essentially of a card and a valve self-supported on the card, the valve including a stepped, annular valve body and a lift strap extending from the body, said card including an aperture, said valve body extending through said aperture with the body step in engagement with one face of the card, said strap being looped tightly around said card and valve and holding said body in said aperture.

12. The packaged valve product of claim 11, said lift strap having an end segment in frictional engagement with said card.

13. The packaged valve product of claim 12, said card including an opening, said end segment extending through said opening.

* * * * *